United States Patent [19]

Sung

[11] Patent Number: 4,505,717

[45] Date of Patent: Mar. 19, 1985

[54] CORROSION INHIBITED MOTOR FUEL

[75] Inventor: Rodney L. Sung, Fishkill, N.Y.

[73] Assignee: Texaco Inc., White Plains, N.Y.

[21] Appl. No.: 624,554

[22] Filed: Jun. 25, 1984

[51] Int. Cl.[3] ..... C10L 1/22

[52] U.S. Cl. ..... 44/53; 44/56; 44/63; 44/72; 252/392

[58] Field of Search ..... 44/56, 53, 63, 72; 252/392; 564/50, 163, 123

[56] References Cited

U.S. PATENT DOCUMENTS 3,409,668 11/1968 Palazzo et al. ..... 564/164
3,780,089 12/1973 Widdig et al. ..... 564/50
4,282,008 8/1981 Sung ..... 44/56

OTHER PUBLICATIONS

Edited by Zabicky, "The Chemistry of Amides", pp. 94 and 95, 1970.

*Primary Examiner*—Mrs. Y. Harris-Smith
*Attorney, Agent, or Firm*—Robert A. Kulason; James J. O'Loughlin; Carl G. Seutter

[57] ABSTRACT

A novel fuel composition contains ethanol or methanol plus, as a corrosion inhibitor, a reaction product of a dialkyl amine and an isatoic anhydride, further reacted with a alkoxyalkyl amine.

26 Claims, No Drawings

CORROSION INHIBITED MOTOR FUEL

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor corrosion inhibiting amount of, as a corrosion inhibiting agent, a reaction product of a di-($C_{12}$–$C_{18}$ hydrocarbonyl) amine and an isatoic anhydride, further reacted with a ($C_2$–$C_3$ alkoxy) ($C_{10}$–$C_{12}$ alkoxy) alkyl primary amine.

DESCRIPTION OF THE INVENTION

The fuel for internal combustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis;

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may commonly be formed by mixing e.g. 90–95 volumes of gasoline with 5–10 volumes of ethanol or methanol. A typical gasohol may contain 90 volumes of gasoline and 10 volumes of absolute ethyl alcohol.

It is preferred that the fuels to be treated by the process of this invention be substantially anhydrous i.e. that they contain less than about 0.3 v % water; typically they may contain 0.001 v %–0.005 v %, say about 0.004 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor corrosion inhibiting amount of, as a corrosion inhibiting agent, a reaction product of a di-(hydrocarbonyl) secondary amine and an isatoic anhydride; further reacted with a ($C_2$–$C_3$ alkoxy) ($C_{10}$–$C_{12}$ alkoxy) alkyl primary amine.

Preparation of the products of this invention may be carried out by reacting an isatoic anhydride with a secondary amine $R_2NH$ thereby forming a first product and then reacting the first product with an alkoxy alkyl primary amine to form the desired product.

The isatoic anhydride which may be employed in practice of the process of this invention may be characterized by the formula:

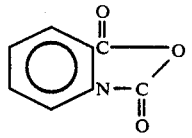

This charge material may bear inert substituents (which do not interfere with the reaction) on the nitrogen atom or on the ring. Typical of these may be alkyl, aralkyl, alkaryl, aryl, or cycloalkyl hydrocarbon substituents. The ring may also bear other inert substituents typified by alkoxy, aryloxy, etc.

The preferred isatoic anhydride is isatoic anhydride se.

The secondary amines (di-hydrocarbonyl amines) which may be employed in practice of the first step of the process of this invention may be characterized by the formula $R_2NH$. Each R group may contain aliphatic or aromatic moieties—including alkyl, alkaryl, aralkyl, aryl, or cycloalkyl groups. The R groups may be different, although they are preferably the same. They may bear inert substituents. Preferably the R group contains 12–18, preferably 12–14, carbon atoms; and most preferably it may be a $C_{12}$–$C_{18}$ n-alkyl group such as cocoyl $C_{12}$. Di-cocoyl amine is the preferred secondary amine. Other secondary amines which may be employed may include:

TABLE

A. Di-(hydrogenated tallowyl) amine
B. Di-oleoyl amine
C. Di-lauroyl amine
D. Di-tallowyl amine
E. Di-stearyl amine
F. Di-soya amine
G. Di-octadecyl amine
H. Di-hexadecyl amine It will be apparent to those skilled in the art that the several reactants may bear inert substituents which are typified by alkyl, alkoxy, etc. It will also be apparent that the preferred compounds to be employed will be those which are soluble in the solvents employed during the reaction and which produce products which are soluble in or compatible with the system in which the product is to be employed.

Typical polar solvents which may be employed may include dimethyl formamide, tetrahydrofuran, dimethyl sulfoxide, etc. A particularly preferred system may include dimethyl formamide.

The first step in the formation of the desired additive in the preferred embodiment may preferably be effected by placing substantially equimolar quantities of an isatoic anhydride and a secondary amine in a reaction vessel in an excess of solvent. A typical solvent (eg dimethyl formamide) may be present in amount of 30–100 volumes, say 70 volumes per 100 volumes of the total of the other reactants. It is not necessary to add catalyst. The reaction mixture may be refluxed at 145° C.–155° C., say 153° C. for 8–24 hours, say 8 hours.

The isatoic anhydride and the secondary amine may react to form a first product.

At the end of the reaction period, the reaction mixture may be cooled to ambient temperature of 20° C.–27° C., say 25° C. and filtered and then stripped (as by distillation at 80° C.–100° C., say 120° C.) of solvent.

The residue which is generally a waxy solid or viscous liquid is recovered in yield approaching stoichiometric.

Although the first product so prepared may be found to possess activity as a rust and corrosion inhibitor, it is preferred to react it further with amine.

In the preferred embodiment, the product so prepared is not isolated, but is reacted further with substantially equimolar amount of ($C_{10}$–$C_{12}$-alkoxy), ($C_2$–$C_3$ alkoxy) alkyl amine having the formula:

$$(C_{10}\text{–}C_{12}\ \text{alkoxy})\text{—}(CH_2\underset{\underset{CH_3}{|}}{C}HO)_n(CH_2CH_2O)_mCH_2\underset{\underset{CH_3}{|}}{C}H\text{—}NH_2$$

wherein n is 0–8 and m is 0–8 and at least one of m or n is other than zero. In one preferred embodiment, n is 1 and m is 0.

Illustrative primary amines which may be employed include the following, the first being most preferred:

TABLE

A. Jeffamine M-300 brand of ether amine $$(C_{10}\text{–}C_{12}\ \text{alkoxy})\text{—}(CH_2CH_2O)\text{—}CH_2\underset{\underset{CH_3}{|}}{C}HNH_2$$

B. $$(C_{10}\text{–}C_{12}\ \text{alkoxy})\text{—}(CH_2\underset{\underset{CH_3}{|}}{C}HO)\text{—}(CH_2CH_2O)CH_2\underset{\underset{CH_3}{|}}{C}HNH_2$$

C. $$(C_{10}\text{–}C_{12}\ \text{alkoxy})\text{—}(CH_2\underset{\underset{CH_3}{|}}{C}HO)_2\text{—}(CH_2CH_2O)_2CH_2\underset{\underset{CH_3}{|}}{C}HNH_2$$

D. $$(C_{10}\text{–}C_{12}\ \text{alkoxy})\text{—}(CH_2\underset{\underset{CH_3}{|}}{C}HO)_2(CH_2CH_2O)CH_2\underset{\underset{CH_3}{|}}{C}HNH_2$$

E. $$(C_{10}\text{–}C_{12}\ \text{alkoxy})\text{—}(CH_2\underset{\underset{CH_3}{|}}{C}HO)_2(CH_2CH_2O)_3CH_2\underset{\underset{CH_3}{|}}{C}HNH_2$$

Practice of this second step of the process of this invention may be carried out by adding the primary amine to the stripped reaction mixture (preferably in equimolar proportions) at ambient temperature of 20° C.–30° C., say 25° C. and stirring for 10–60 minutes, say 60 minutes. The final product so formed may be analyzed by IR and NMR.

Typical of the products so prepared may be those noted in the following table:

TABLE

I. The product formed by reacting equimolar amounts of the reaction product of isatoic anhydride and di-N—(cocoyl) amine; with Jeffamine M-300 brand of $$(C_{10}H_{21}\text{—}O)\text{—}(CH_2\underset{\underset{CH_3}{|}}{C}HO)_nCH_2\underset{\underset{CH_3}{|}}{C}H\text{—}NH_2$$

II. The product formed by reacting equimolar amounts of the reaction product of isatoic anhydride and di-N—(oleyl) amine; with $$(C_{10}\text{–}C_{12}\ \text{alkoxy})\text{—}(CH_2\underset{\underset{CH_3}{|}}{C}HO)_2\text{—}(CH_2CH_2O)\text{—}CH_2\underset{\underset{CH_3}{|}}{C}H\text{—}NH_2$$

III. The product formed by reacting equimolar amounts of the reaction product of isatoic anhydride and di-N—(stearyl)amine; with $$(C_{10}\text{–}C_{12}\ \text{alkoxy})\text{—}(CH_2\underset{\underset{CH_3}{|}}{C}HO)_2\text{—}(CH_2CH_2O)\text{—}CH_2\underset{\underset{CH_3}{|}}{C}H\text{—}NH_2$$

IV. The product formed by reacting equimolar amounts of the reaction product of isotoic anhydride and di-N—(tallow) amine; with $$(C_{10}\text{–}C_{12}\ \text{alkoxy})\text{—}(CH_2\underset{\underset{CH_3}{|}}{C}HO)_2\text{—}(CH_2CH_2O)\text{—}CH_2\underset{\underset{CH_3}{|}}{C}H\text{—}NH_2$$

V. The product formed by reaching equimolar of the reaction product of isatoic anhydride and di-N—(hexadecyl) amine; with $$(C_{10}\text{–}C_{12}O)\text{—}(CH_2\underset{\underset{CH_3}{|}}{C}HO)\text{—}(CH_2\underset{\underset{CH_3}{|}}{C}HO)NH_2$$

The so prepared rust and corrosion inhibitor may be added to fuels (including alcohol, gasoline, gasohol etc.) or to antifreeze. These compositions may be particularly found to be effective as rust and corrosion inhibitors when added to absolute alcohol fuels typified by those available commercially containing components including ethers, esters, acids, etc.

The so prepared rust and corrosion inhibitors may be added to a fuel in amount of 0.25–25 PTB, preferably 1–20 PTB, more preferably 1–10 PTB, say 10 PTB. (PTB stands for pounds of additive per thousand barrels of fuel). Alternatively expressed, the inhibitor may be added to a fuel in minor corrosion-inhibiting amount of 0.0001–0.01 w %, preferably 0.0004–0.008 w %, more preferably 0.0004–0.0040 w %, say 0.0040 w %. Larger amounts may be employed but may not be necessary.

It is a feature of this invention that the fuel composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 100 ml of the test liquid in a 4 ounce bottle for 15 minutes at room temperature of 20° C. 20 ml of the test liquid is poured off and replaced with 20 ml of distilled water. The bottle is shaken the sample is maintained for 3 hours at 90° F. The percent rust on the strip is determined visually. A second reading is taken after 40 hours.

The inhibited fuels of this invention, after 40 hours of ISCT generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode know of preparing the product of this invention 20 parts of isatoic anhydride, 100 parts of dimethylformamide DMF, and 51 parts of Armeen 2C brand of di-cocoyl amine may be refluxed in a reaction vessel for 8 hours. The mixture is then filtered and stripped of DMF by heating to 120° C. for 2 hours. In this embodiment, the first or intermediate product is not separated but is converted to final product by stirring for 1 hour at 25° C. with 31 parts of Jeffamine M-300 brand of $$(C_{10}\text{–}C_{12}O)\text{—}(CH_2\underset{\underset{CH_3}{|}}{C}HO)\text{—}CH_2\underset{\underset{CH_3}{|}}{C}H\text{—}NH_2$$

Analysis is by IR and NMR.

EXAMPLE II

The additive product prepared in Example I (380 ppm corresponding to 100 PTB) is added to 90 parts of the anhydrous alcohol composition of Table I and 10 parts of distilled water and the resulting composition was tested in the ISCT to determine the Rust and Corrosion rating after 6 days.

EXAMPLE III*

The procedure of Example II was duplicated except that the additive was 76 PTB of a commercial rust and corrosion inhibitor.

The fuel composition was tested in the ISCT.

*designates a control example; all others are experimental examples.

EXAMPLE IV*

The procedure of Example II was duplicated except that no additive was present—only 10 parts of distilled water.

The results of the Iron Strip Corrosion Test were as follows:

TABLE

| Example | 6 Day Rust & Corrosion Rating |
|---|---|
| II | 0 |
| III* | 100% |
| IV* | 100% |

From the above table, it will be apparent that the system of Example II, prepared in accordance with practice of the process of this invention, showed no rust and corrosion. Control Examples III*–IV* showed 100% rust and corrosion which is unsatisfactory.

Results comparable to those of Example II may be obtained when the secondary amine reacted is:

TABLE

| Example | Secondary Amine |
|---|---|
| V | Di-(oleyl) amine |
| VI | Di-(tallowyl) amine |
| VII | Di-(stearyl) amine |

Results comparable to those of Example II may be obtained when the isatoic anhydride reactant is:

TABLE

| Example | Reactant |
|---|---|
| VIII | 3-methyl isatoic anhydride |
| IX | 3-ethyl isatoic anhydride |
| X | 3-propyl isatoic anhydride |
| XI | 3-butyl isatoic anhydride |

Results comparable to those of Example II may be obtained when the primary amine reactant is:

TABLE

| Example | Amine |
|---|---|
| XII | $(C_{10}\text{–}C_{12}O)\text{—}(CH_2\underset{\underset{CH_3}{\vert}}{C}HO)\text{—}(CH_2CH_2O)CH_2\underset{\underset{CH_3}{\vert}}{C}HNH_2$ |
| XIII | $(C_{10}\text{–}C_{12}O)\text{—}(CH_2\underset{\underset{CH_3}{\vert}}{C}HO)_2(CH_2CH_2O)CH_2\underset{\underset{CH_3}{\vert}}{C}HNH_2$ |
| XIV | $(C_{10}\text{–}C_{12}O)\text{—}(CH_2\underset{\underset{CH_3}{\vert}}{C}HO)_2(CH_2CH_2O)_2CH_2\underset{\underset{CH_3}{\vert}}{C}HNH_2$ |

Results comparable to those of Example II may be obtained if the fuel is as follows:

| Example | Fuel |
|---|---|
| XV | Gasohol containing 90 v % gasoline and 10 v % absolute ethanol |
| XVI | absolute ethanol |
| XVII | absolute methanol |

Although this invention has been illustrated by reference to specific embodiments, it will be apparent to those skilled in the art that various changes and modifications may be made which clearly fall within the scope of this invention.

I claim:

1. A fuel composition for internal combustion engines comprising
   (a) a major portion of a fuel containing (i) at least one alcohol selected from the group consisting of ethanol and methanol and (ii) gasoline in amount of 0–50 volumes per volume of alcohol; and
   (b) a minor corrosion inhibition amount of, as a corrosion inhibiting agent, a reaction product in polar solvent of (i) a di-(hydrocarbonyl secondary amine and (ii) an isatoic anhydride; further reacted at ambient temperature with a ($C_2$–$C_3$ alkoxy) ($C_{10}$–$C_{12}$ alkoxy) primary amine.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 wherein said hydrocarbon is a $C_{12}$–$C_{18}$ alkyl group.

12. A fuel composition for internal combustion engines as claimed in claim 1 wherein said hydrocarbon is a $C_{12}$–$C_{14}$ alkyl group.

13. A fuel composition for internal combustion engines as claimed in claim 1 wherein said hydrocarbon is cocoyl.

14. A fuel composition for internal combustion engines as claimed in claim 1 wherein said primary amine is $$(C_{10}\text{-}C_{12}\text{ alkyl O})-(CH_2\underset{\underset{CH_3}{|}}{C}HO)_n-CH_2\underset{\underset{CH_3}{|}}{C}H-NH_2$$

15. A fuel composition for internal combustion engines as claimed in claim 1 wherein said primary amine is $$(C_{10}\text{-}C_{12}O)-(CH_2\underset{\underset{CH_3}{|}}{C}HO)-(CH_2CH_2O)-CH_2\underset{\underset{CH_3}{|}}{C}HNH_2$$

16. A fuel composition for internal combustion engines as claimed in claim 1 wherein said primary amine is $$(C_{10}\text{-}C_{12}O)-(CH_2\underset{\underset{CH_3}{|}}{C}HO)_2-(CH_2CH_2O)_2-CH_2\underset{\underset{CH_3}{|}}{C}HNH_2$$

17. A fuel composition for internal combustion engines as claimed in claim 1 wherein said secondary amine is di-(CoCo)amine.

18. A fuel composition for internal combustion engines as claimed in claim 1 wherein said corrosion inhibiting agent is present in minor corrosion inhibiting amount of 0.0001 w %–0.005 w % of said fuel composition.

19. A fuel composition for internal combustion engines comprising (a) a major portion of a fuel containing absolute ethanol; and (b) a minor corrosion inhibiting amount, 0.0001 w %–0.005 w % of said fuel composition, of as a corrosion inhibiting agent, a reaction product in polar solvent of (i) a di-(hydrocarbonyl secondary amine and (ii) an isatoic anhydride; further reacted at ambient temperature with (iii) a ($C_2$–$C_3$ alkoxy) ($C_{10}$–$C_{12}$ alkoxy) alkyl primary amine.

20. A composition comprising a reaction product in polar solvent of (i) a di-(hydrocarbonyl secondary amine and (ii) an isatoic anhydride; further reacted at ambient temperature with (iii) a ($C_2$–$C_3$ alkoxy) ($C_{10}$–$C_{12}$ alkoxy) alkyl primary amine.

21. A composition as claimed in claim 20 wherein said product amine is $$(C_{10}\text{-}C_{12}\text{ alkyl O})-(CH_2\underset{\underset{CH_3}{|}}{C}HO)_n-CH_2\underset{\underset{CH_3}{|}}{C}H-NH_2$$

22. A composition as claimed in claim 20 wherein said primary amine is $$(C_{10}\text{-}C_{12}O)-(CH_2\underset{\underset{CH_3}{|}}{C}HO)-(CH_2CH_2O)-CH_2\underset{\underset{CH_3}{|}}{C}HNH_2$$

23. A composition as claimed in claim 20 wherein said primary amine is $$(C_{10}\text{-}C_{12}O)-(CH_2\underset{\underset{CH_3}{|}}{C}HO)_2-(CH_2CH_2O)_2-CH_2\underset{\underset{CH_3}{|}}{C}HNH_2$$

24. A composition as claimed in claim 20 wherein said primary amine is di-(oleyl) amine.

25. A composition as claimed in claim 20 wherein said primary amine is di-(stearyl) amine.

26. A composition as claimed in claim 20 wherein said primary amine is di-(tallowyl) amine.

* * * * *